US005336122A

United States Patent [19]

Lewis

[11] Patent Number: 5,336,122

[45] Date of Patent: Aug. 9, 1994

[54] EDUCATIONAL APPARATUS WITH PUMP FOR USE IN BATHTUB

[76] Inventor: James C. Lewis, 2422 N. 15th St., Springfield, Oreg. 97477

[21] Appl. No.: 966,541

[22] Filed: Oct. 26, 1992

[51] Int. Cl.[5] ..... A63H 23/00

[52] U.S. Cl. ..... 446/153; 446/166; 446/177

[58] Field of Search ..... 446/153, 166, 167, 176, 446/177, 156, 159; 239/215, 222.17, 282; 434/126, 300; 415/124; 472/128

[56] References Cited

U.S. PATENT DOCUMENTS

| | | | |
|---|---|---|---|
| 1,217,885 | 2/1917 | Bliss | 446/166 |
| 1,966,325 | 7/1934 | Welch | 415/124 |
| 2,787,863 | 4/1957 | Laird | 446/166 |
| 3,535,798 | 10/1970 | Turman | 434/126 |
| 3,577,675 | 5/1971 | Kohner et al. | 446/177 X |

FOREIGN PATENT DOCUMENTS

| | | | |
|---|---|---|---|
| 2222782 | 3/1990 | United Kingdom | 446/479 |

*Primary Examiner*—Mickey Yu

*Attorney, Agent, or Firm*—James D. Givnan, Jr.

[57] ABSTRACT

An apparatus for use by children includes a hand operated pump provided with a hose for the delivery of water from a bathtub to a wall-mounted system of water conduits. The pump includes a hand crank with meshed gears to provide a positive displacement flow to the conduit system. Various devices included in the conduit system such as a water wheel and a water driven turbine, both attachable to a wall adjacent the bathtub by suction cups, as are other components of the conduit system. The suction cups permit convenient installation and disassembly of the present apparatus. Additional components of the conduit system include a multitude of conduits providing a conduit network through which the child may observe a water flow.

10 Claims, 2 Drawing Sheets

EDUCATIONAL APPARATUS WITH PUMP FOR USE IN BATHTUB

BACKGROUND OF THE INVENTION

The present invention pertains generally to educational devices for young children and particularly to such devices having an array of components for selective assembly by the child.

In the prior art are various apparatuses for assembly by a child which permit the child to assemble the components in various combinations.

Some of these apparatuses include small mechanical devices to permit the child to use his mechanical skills to assemble working models. To the extent known, such previous efforts have been directed toward apparatuses not utilizing hand operated water pumps operated by a child and with conduits, vessels, valves and water driven devices in place in a removable manner, on a room wall.

SUMMARY OF THE PRESENT INVENTION

The present invention is embodied in an educational apparatus for use in the bath or other water containment area with pressurized water being delivered to one or more wall mounted components directing, conducting or utilizing a water flow controlled by the child.

A pump is provided with a hand crank which draws water from the bathtub or other water containment area and delivers same to various wall mounted devices for entertainment and/or educational purposes. The devices are attachable to a wall surface such as a wall adjacent the bathtub in a selective manner to allow the child to experiment with the effect of gravity on water flow or merely for entertainment purposes. A turbine is provided with a reel to display the effect of low velocity and high velocity water flows on the turbine wheel and its power output. A resevoir is provided with a valve controlled outlet and a conduit system preferably of clear plastic material which provides a visual display for the child of the course of the water flow in response to gravity.

Important objectives of the present invention include the provision of an apparatus for assembly on a wall surface and utilizing a water flow controlled by the child; the provision of an apparatus for removable installation on a room wall surface permitting unlimited variations of assemblies by the child and with the child controlling a continuous pressurized fluid flow through the apparatus by a hand operated pump which may be partially submerged in bath water; the provision of an educational and/or toy water system wherein the child operates a positive displacement pump, the discharge from which may drive various water driven devices; the provision of a wall mounted apparatus for mounting on a wall by means of suction cups to permit assembly by the child in a selective manner and removal of apparatus components from the wall by the child to return the wall to its unencumbered state.

DETAILED DESCRIPTION OF THE PREFERRED EMBODIMENTS

Figure 1:
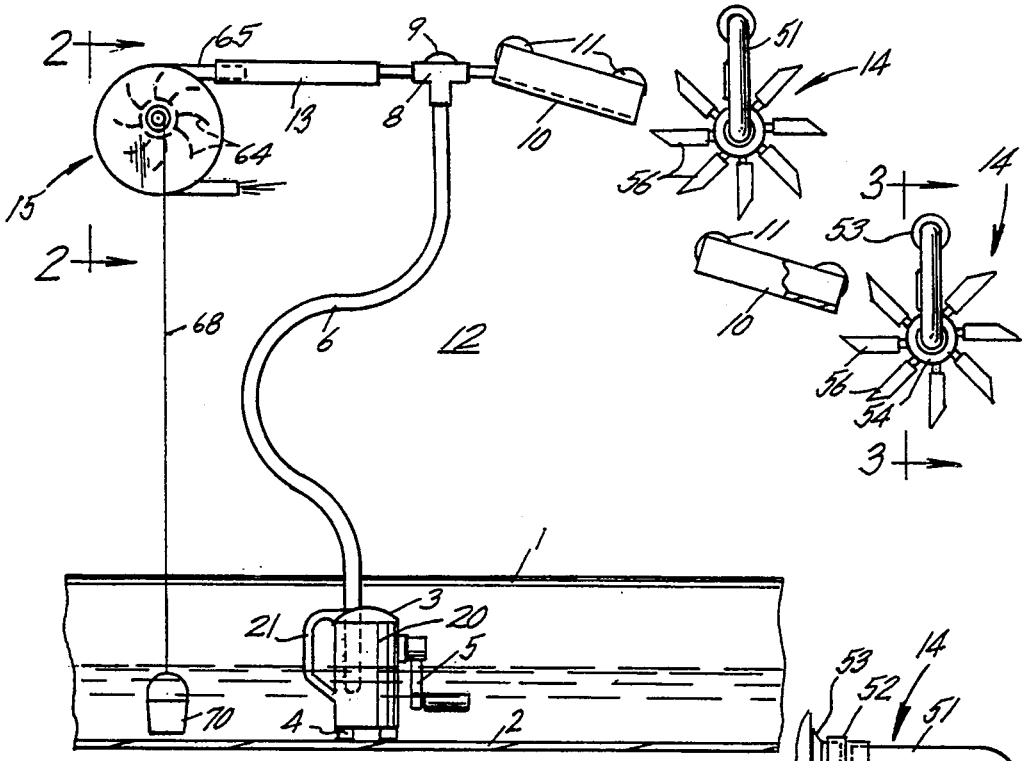
FIG. 1 is an elevational view of a bathroom wall with a bathtub in vertical section with components of the apparatus in place thereon.

With continuing attention to the drawings wherein applied reference numerals indicate parts similarly hereinafter identified, the reference numeral 1 indicates a bathtub or other water containment area having a bottom 2. Indicated at 3 is a water pump (later described) provided with feet 4 of rubber or other resilient material. A hand crank 5 is operable by the user to provide a continuous pressurized water flow through a hose 6 coupled at one end to the pump 3.

Conduit means receives a water flow from hose 6 and includes a tee 8, supported by a suction cup 9 which directs the water flow to additional conduit means components such as a trough at 10 with suction cups at 11 thereon for installation on or attachment to an upright wall 12 adjacent to bathtub 1. If desired, the troughs at 10 of the conduit means may be located subjacent a water wheel indicated generally at 14. A tubular conduit at 13 delivers water to a turbine generally at 15 which is preferably of a transparent material. The water wheels 14 are described in detail below.

Pump 3 includes a housing 20 equipped with a handle 21 which permits the child to stabilize the pump during rotation of hand crank 5. A shaft 22 is journaled in the housing and is equipped with a gear drive having a pair of bevel gears 23. Driven bevel gears are at 24 each of which is carried at the end of drive shaft 25 which is suitably journaled at 29 within the pump housing. Disposed within a chamber 26 are gears 27 and 28 in mesh to provide a pressurized water flow by the positive displacement of water drawn through an inlet 30 in the bottom 31 of the housing. An outlet 32 from the pressure area of chamber 26 terminates at the exterior of the pump housing whereat a nipple at 32A is provided for reception of an end of hose 6. Accordingly, with the pump placed on bathtub bottom 2, operation of the hand crank 5 will result in a continuous flow of water being delivered at a rate controlled by crank efforts of the child to the conduit means in place on wall surface 12.

Figure 4:
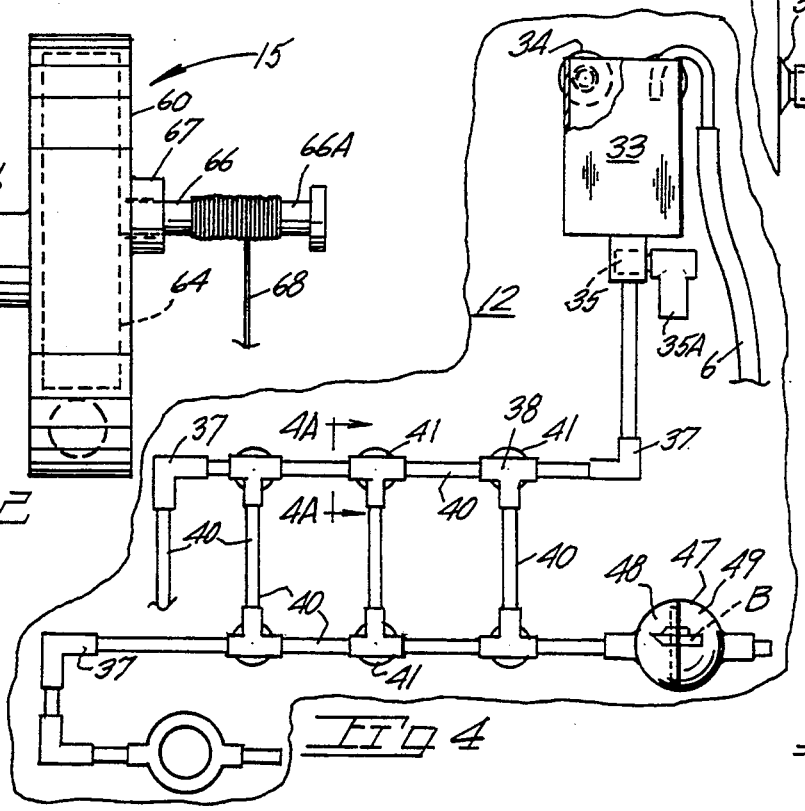
FIG. 4 is an elevational view of conduit means which demonstrates the gravitational flow of water through a system of conduits.
Figure 4A:
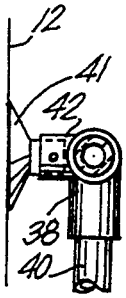
FIG. 4A is a sectional view taken along line 4A—4A of FIG. 4
Figure 5:
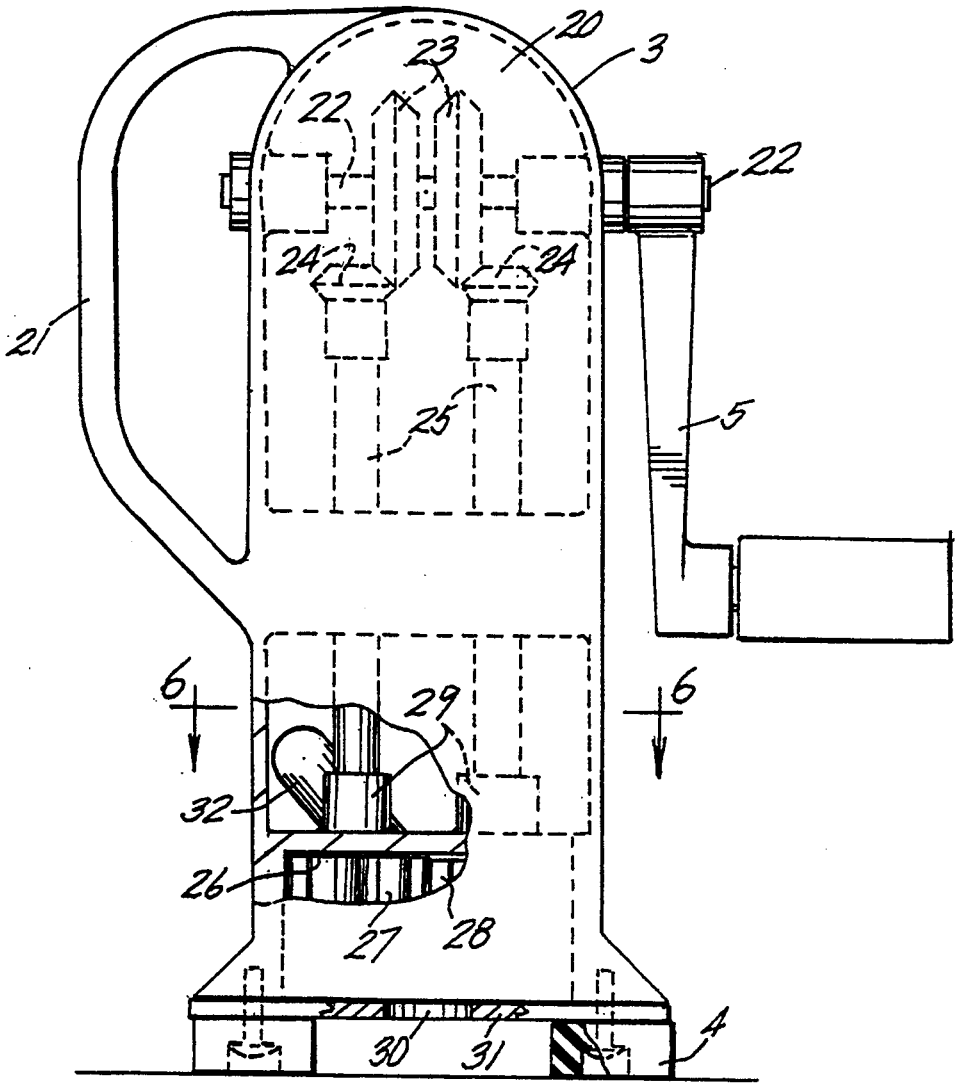
FIG. 5 is a front elevational view of a water pump of the apparatus.
Figure 6:
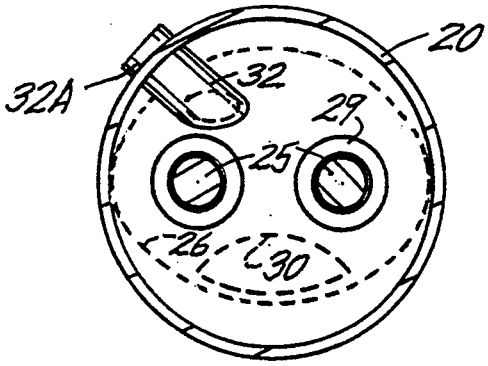
FIG. 6 is a horizontal section taken along line 6—6 of FIG. 5.

With attention to FIG. 4 showing another embodiment of the invention, a resevoir at 33 is fed by hose 6 with the resevoir being attached to wall 12 by means of suction cup as at 34. The gravitational flow of water through the conduit means of FIG. 4 and from resevoir 33 is controlled by a valve 35 having manually positionable handle 35A. Members are of tublar construction and include elbows 37 and tees 38 coupled to one another by tubes 40. For wall attachment purposes the tees 38 include suction cups 41 suitably affixed in a socket 42. A spherical conduit 47 includes hemispheres 48 and 49 threadedly joined to permit separation of the hemisphere to enable the child to insert various articles as for example a minature boat B. The conduit means components are of transparent material to permit the child to view the flow of water therethrough.

Figure 3:
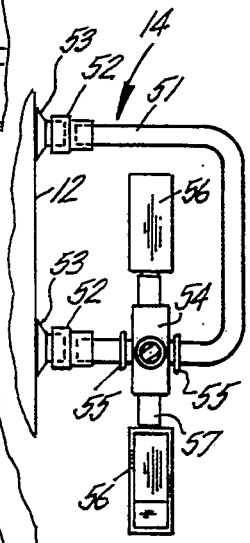
FIG. 3 is a vertical sectional view taken along line 3—3 of FIG. 1.

With attention now to FIG. 3 and the water wheel indicated generally at 14, the same includes a base 51 having a U-shaped member fitted at its end with couplers 52 which receive suction cups 53. Disposed on one of the arms of the U-shaped base 50 is a water wheel hub 54 held in place by 0-rings 55 snugly fitted on the base arm. Water wheel buckets are at 56 each carried by a hub mounted arm 57.

Figure 2:
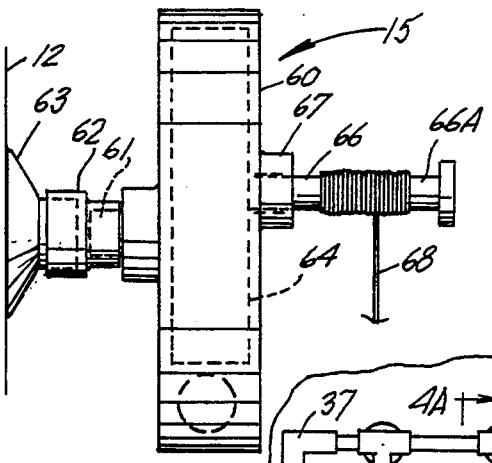
FIG. 2 is a side elevational view of a turbine taken along line 2—2 of FIG. 1.

The water turbine 15 is best shown in FIG. 2 and includes a housing 60 having a projection 61 on which is mounted a coupler 62 which also insertably receives the base of a suction cup 63. Accordingly, housing 60 is attachable in a removable manner to wall surface 12. Within housing 60 is a turbine wheel having blades 64 which rotate into the path of water entering via an inlet 65 as shown in FIG. 1. A turbine axle 66 journaled in a sleeve 67 on housing 60 and includes an extension 66A serving as a spool to receive a quantity of line 68 which upon turbine rotation by water is retrieved to lift an article such as a minature bucket 70 at the line end.

In use, the child may assemble the components of the apparatus in a myriad of combinations as well as disassemble and remove same from the wall surface all without the use of any tools. Further, various simple experiments may be attempted by the child to promote his or her interest in science.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. An apparatus for installation in a water containment area and on a wall adjacent the water containment area, said apparatus including a positive displacement water pump including a hand crank for placement in the water of said water containment area, a flexible hose coupled to said pump, and conduit means in communication with said hose for attachment to said wall in a selective manner and including wall attachable suction cups.

2. The apparatus claimed in claim 1 wherein said water pump includes a housing, feet of elastromeric material on said housing to elevate the pump housing from a supporting surface.

3. The apparatus claimed in claim 1 wherein said conduit means includes a water wheel having a base, suction cups on said base for wall attachment purposes, O-rings on said base and confining the water wheel against axial displacement.

4. The apparatus claimed in claim 1 wherein said conduit means includes a turbine, said turbine including a housing of transparent material, a suction cup on said housing for attaching said housing to the wall, a coupler coupling said suction cup to the housing.

5. The apparatus claimed in claim 4 wherein said turbine includes an axle having an extension serving as a spool, a line wound on said spool, the rotational speed of the axle normally in direct proportion to the rotational speed of the pump hand crank.

6. The apparatus claimed in claim 1 wherein said conduit means includes a conduit network of elbows and tees assembled by the user, a reservoir in communication with said network, suction cups attaching said conduit network to the wall, said hose serving said reservoir.

7. The apparatus claimed in claim 6 wherein said conduit network includes a valve regulating the flow of water from said reservoir.

8. The apparatus claimed in claim 7 wherein said pump includes gears enmesh of the continuous positive displacement of water.

9. The apparatus claimed in claim 8 wherein said pump includes a housing, a handle integral with said housing for manually stabilizing the pump during pump operation.

10. The apparatus claimed in claim 9 wherein said pump includes sets of bevel gears powered by said hand crank, shafts one each coupled to one of said sets of bevel gears and to sad gears enmesh.

* * * * *